US008710385B2

(12) United States Patent
Sickels

(10) Patent No.: US 8,710,385 B2
(45) Date of Patent: Apr. 29, 2014

(54) RELIABILITY FIRE PRESSURE SWITCH

(76) Inventor: Robert Butch Sickels, Mansfield, TX (US)

( * ) Notice: Subject to any disclaimer, the term of this patent is extended or adjusted under 35 U.S.C. 154(b) by 242 days.

(21) Appl. No.: 13/465,542

(22) Filed: May 7, 2012

(65) Prior Publication Data

US 2013/0291751 A1 Nov. 7, 2013

(51) Int. Cl.

| | |
|---|---|
| ***H01H 3/24*** | (2006.01) |
| ***H01H 35/24*** | (2006.01) |
| ***H01H 35/38*** | (2006.01) |

(52) U.S. Cl.
USPC ..... 200/82 R

(58) Field of Classification Search
USPC ..... 200/82 R, 6 R, 8 R, 16 R, 424, 79, 83 A, 200/209
See application file for complete search history.

(56) References Cited

U.S. PATENT DOCUMENTS

| | | | | |
|---|---|---|---|---|
| 4,208,966 | A | | 6/1980 | Hart |
| 4,234,767 | A | | 11/1980 | Davis et al. |
| 4,266,613 | A | * | 5/1981 | Boop ..... 166/299 |
| 4,454,814 | A | | 6/1984 | Henry et al. |
| 4,457,383 | A | | 7/1984 | Boop |
| 4,496,010 | A | | 1/1985 | Chapman |
| 4,527,636 | A | | 7/1985 | Bordon |
| 4,778,009 | A | | 10/1988 | Sumner et al. |
| 4,991,684 | A | | 2/1991 | Mitchell |
| 5,521,164 | A | | 5/1996 | della Valle et al. |
| 5,531,164 | A | | 7/1996 | Mosley |
| 5,700,969 | A | | 12/1997 | Mosley |

* cited by examiner

*Primary Examiner* — Edwin A. Leon
*Assistant Examiner* — Anthony R. Jimenez
(74) *Attorney, Agent, or Firm* — Gardere Wynne Sewell LLP

(57) ABSTRACT

A down-hole fire pressure switch is disclosed having improved operating characteristics including improved reliability and higher pressure resistance.

5 Claims, 3 Drawing Sheets

RELIABILITY FIRE PRESSURE SWITCH

TECHNICAL FIELD

This invention relates to an improved fire pressure switch used in selectively firing multiple explosive charges during completion of a gas or an oil well. In particular, the fire pressure switch disclosed herein has increased reliability compared to existing fire pressure switches. The preferred embodiment also improves the pressure resistance of the switch after a charge has been fired.

BACKGROUND ART

Fire pressure switches are used to sequentially fire charges during the completion of a gas or oil well. After the initial well is drilled, production can be increased by fracturing the formation using directed or shaped charges. To accomplish the fracturing ("fracing") of the well, a string of shaped charges is fed into the well to the point where fracing is desired. Each charge is set off in sequence by an electrically triggered detonator which is electrically connected to the surface. Typically, the charges are triggered by alternating positive and negative voltages with appropriately configured diodes so that only the desired charge is triggered. After a particular charge is detonated, the next charge is moved closer to the opening of the well and the process is repeated.

The undetonated charges must be isolated from any water or other fluids released from the previous charge. It is also necessary to isolate the charges electrically from each other so that only the last one in a string is detonated and so that after each charge is detonated, the next one is electrically connected so that it can be detonated. The fire pressure switch uses the pressure pulse from the detonation to move a piston towards a plunger, breaking one electrical circuit and making the next. The newly completed electrical circuit allows the next detonator in the string to become active.

To accomplish this result, three different fire pressure switches are used: a double diode, positive diode and negative diode. The first charge in the string uses a double diode pressure switch. After the first charge, the remaining charges in the string use alternating positive and negative diodes so that each charge is properly detonated in sequence.

The basic arrangement to which the invention disclosed herein is directed is described in U.S. Pat. No. 4,234,768 which is incorporated herein as part of the background of the invention. U.S. Pat. No. 5,531,164 discloses another configuration for sequential detonation of explosive charges including the use of fire pressure switches. Titan Specialties is a supplier of oil field tooling, including fire pressure switched. Titan Specialties sells a fire pressure switch have a configuration of components similar to the configuration of components disclosed herein. Including a switch having a case, piston, spring biased dart and insert functioning similarly to the invention. However, the Titan Specialties switches currently available have has reliability issues and alternative switches disclosed in U.S. Pat. Nos. 4,234,768 and 5,531,164 can be improved. Such reliability problems can be very expensive because when the fire pressure switch fails, the entire string must be retrieved and the failed component replaced.

SUMMARY OF THE INVENTION

An embodiment of the invention comprises a case having a first down-hole end and a second up-hole end and an axial passage therethrough; the axial passage having at least two sections having different diameters; an electrically conductive piston having a down-hole end and an up-hole end, the second end having a recessed portion; a portion of the up-hole portion of the piston surrounded by an injection molded sheath; the piston having one or more circumferential grooves which are filled with insulating material comprising portions of the sheath; the sheath frictionally engaging a portion of the axial passage of the case; a space between the up-hole end of the piston and the down-hole end of an insert; a lubricant in the space comprising approximately 0.0065 ounces of lubricant; a conductive rigid dart having a conical down-hole head and a tapered up-hole tail; a portion of the tapered tail surrounded by a spring; the spring maintaining the dart in electrical connection with the piston and permitting movement of the dart between a position which is electrically insulated from the insert and a position which is electrically connected to the insert; the dart having an insulating sleeve surrounding a portion of the tail; an insert having an electrically conductive inner portion and an electrically insulated sheath and having an axial passage having a diameter larger than the diameter of the dart; the electrically insulating sheath having a uniform outer diameter which is large than the interior diameter of the corresponding portion of the case by between 0.001 and 0.01 inches. In a preferred embodiment the case is anodized and has an exterior color indicative of the type of diode connected to the switch. After an explosive blast has occurred, the switch of the invention preferably withstands at least 20,000 pounds per square inch of pressure without appreciable leakage of material, particularly water, from the down-hole side of the switch towards the surface. In a further preferred embodiment, the fire pressure switch of the invention further comprises a wire electrically connected to the piston and a clear sleeve surrounding the piston, wire and electrical connection.

An alternative embodiment replaces the dart with a wire which is electrically connected to the up-hole end of the piston, providing a simple, non-switching, electrical connection while retaining the pressure resistance capabilities of the switch.

DETAILED DESCRIPTION OF THE PREFERRED EMBODIMENT

Figure 1:
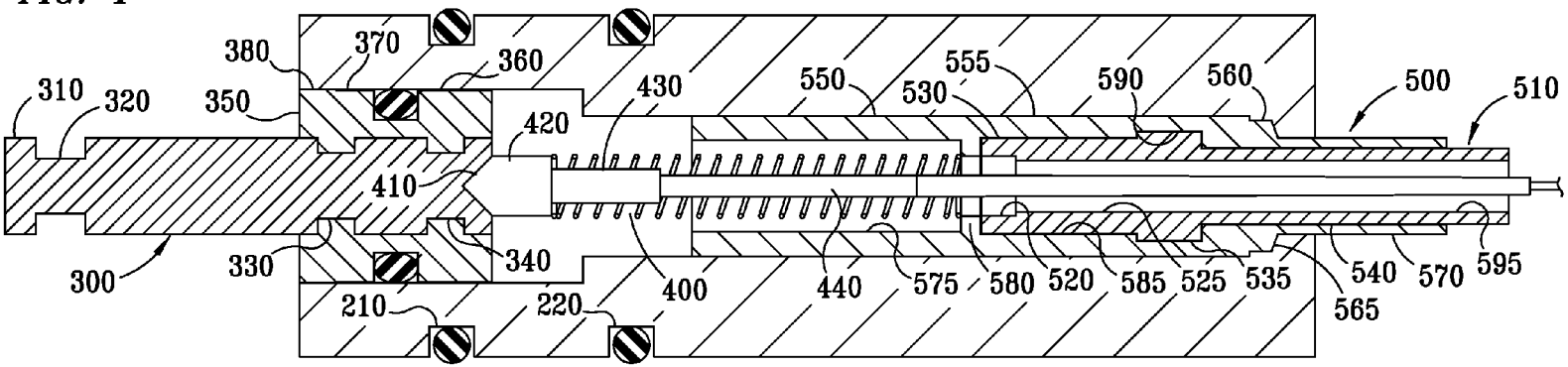
FIG. 1. Cross section of the fire pressure switch
FIG. 2. Cross section of the case
FIG. 3. Cross section of the piston
FIG. 4. Cross section of the dart
FIG. 5. Cross section of the insert
FIG. 6. Cross section of non-switching embodiment

The invention is an improved fire pressure switch having improved reliability. FIG. 1 shows the primary components of the improved fire pressure switch 100. The switch 100 has a case 200, a piston 300, a dart 400, an insert 500 and appropriate wiring. Each of these components is described in detail below. To the extent not stated specifically below, each dimension stated herein has a tolerance not greater than 0.003 inches. Preferably, tolerances may be 0.002 inches or less.

Figure 2:
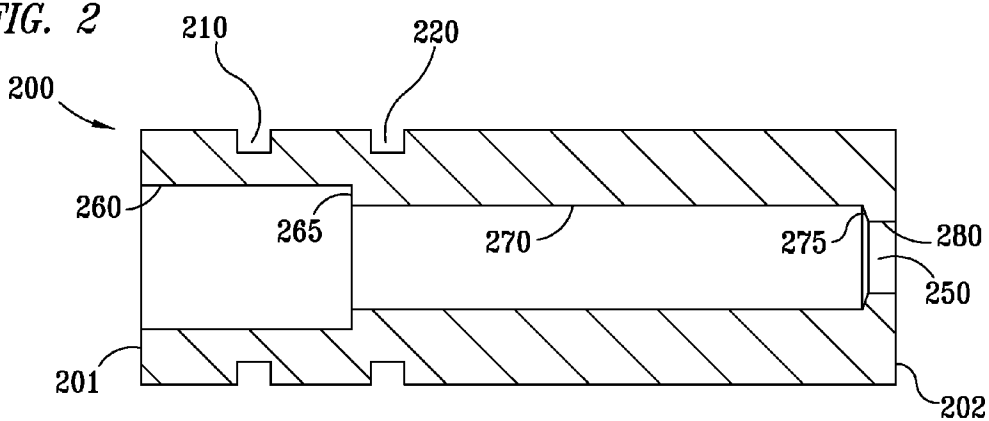

FIG. 2 shows the configuration of the case 200. Case 200 has an axial passage 250 therethrough. Preferably the case 200 is made of aluminum and is color-coded and anodized. The case is a generally cylindrical body with first (down-hole) planar end 201 and second (up-hole) planar end 202, one or more circumferential grooves (210, 220) and a central passage 250 through the body along its longitudinal axis. The axial passage is generally circular with three sections 260, 270, 280 each having an internal diameter. The outside diameter of the case is 0.750 inches and its overall length is 2.00 inches. The internal diameter of the first section 260 is 0.374 inches, the internal diameter of the second section 270 is 0.312 inches, and the internal diameter is of the third section 0.223 inches. Each of these diameters has a tolerance of 0.001 inches. The transition from first section 260 to second section 270 creates shelf 265 which has a width of 0.031 inches. The transition from second section 270 and third section 280 creates shelf 275 which has a width of 0.0445 inches. The length of the first section 260 is 0.562 inches. The length of the second section 270 is 1.239 inches and the length of the third section 280 is 0.200 inches. The case preferably also has two annular grooves 210, 220 each having a width of 0.125 inches. The first annular groove is 0.256 inches from the first end of the case. The second annular groove is 0.250 inches from the end of the first annular groove. Each annular groove has a width of 0.125 inches. The annular grooves are configured to receive O-rings, not shown. Each of these dimensions has a tolerance of 0.002 inches.

The case is preferably anodized to enhance the electrical isolation between the case and the environment. The case is also preferably selectively colored to indicate which type of diode it has. For example, the case may be red for positive, black for negative and blue for both.

Figure 3A:
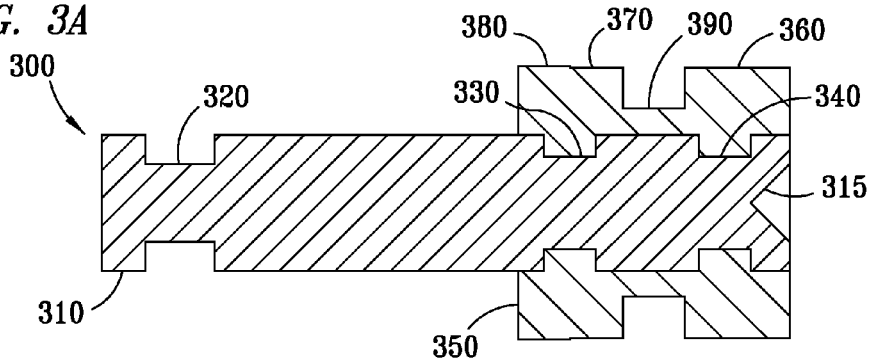
Figure 3B:
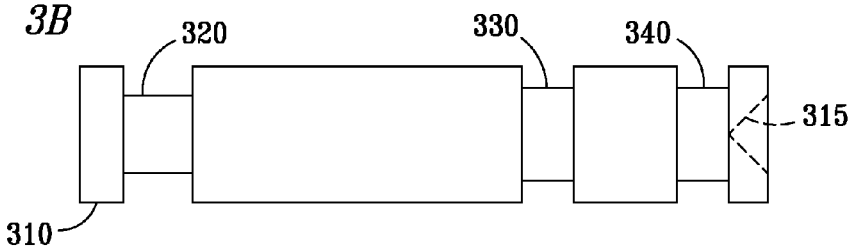
Figure 3C:
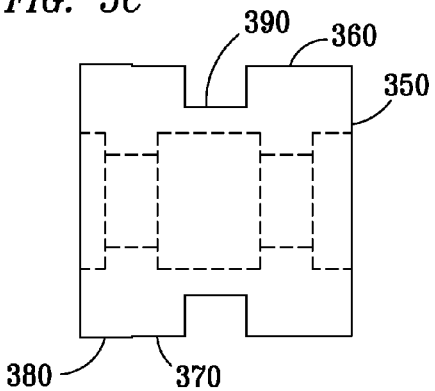

FIG. 3 is a cross section of the piston 300. Further details are shown in FIGS. 3A, 3B, and 3C. The piston 300 has an electrically conducting shaft 310 partially electrically insulated with sheath 350. Piston 300 has a first down-hole end and a second up-hole end, the second end having a recessed portion. The recess may be concave, conical or other recessed shape. Near the first down-hole end is first circumferential groove to receive an electrical connection. A portion near the second end of shaft 310 is electrically insulated from the case and contains two circumferential grooves. Known fire pressure switches use a threaded connection between the electrically conductive piston 310 and its insulating sheath 350. The threaded connection is believed to have reliability problems because it can be improperly threaded during assembly of the switch, can change during use and the geometric relation between the piston and case is more difficult to maintain precisely. The shaft is preferably made of brass.

A wire (not shown) electrically connecting the piston to the down-hole switch and blasting cap is connected to piston 300. The through wire is typically yellow or white but may be any color which is distinctive and facilitates proper assembly of the switch. Typically, the through wire is connected towards the down-hole end of the piston and typically is soldered to the piston for stable electrical connectivity. The piston, through wire and electrical connection may be protected by a flexible sleeve. Preferably, a clear sleeve is used both to protect the connection and facilitate visual confirmation that the connection has not been harmed before placing the switch into service. The preferred material for the sleeve is silicon. The use a clear sleeve permits inspection of the electrical connection prior to use to avoid use of a damaged switch. The sleeve also protects the piston from forming an electrical connection with the case if the piston is bent prior to or during use or assembly of the string.

The electrically conductive shaft 310 has a diameter of 0.188 inches. The first circumferential groove 320 is located 0.060 inches from the first, down-hole end and has a width of 0.096 inches. The diameter of the piston in the first circumferential groove is 0.107 inches. The second circumferential groove 330 is located 0.610 inches from the first, down-hole end and has a width of 0.072 inches and a diameter of 0.128 inches. The third circumferential groove 340 is located 0.824 inches from the first end and has a width of 0.072 inches and a diameter of 0.128 inches. The second and third circumferential grooves are to enhance the friction fit between the shaft 310 and insulating plastic sheath 350 around the piston body 310. The final portion of the piston body has a length of 0.056 inches. The overall length of the piston is 0.950 inches. The final portion of the piston body has a 90 degree conical recessed portion 315 centered on the longitudinal axis of the piston body. Other recessed shapes may also be used such as concave, frustoconical or other recessed shape.

The piston includes an injection molded plastic insulating sheath 350 which is shown in FIG. 3C. The sheath is preferably made of Riton, a high temperature plastic. Molding the plastic onto the shaft provides for precise control of the dimensions of the component and attendant precise control of the geometric relationship between the piston 300 and the case 200, allowing for increased reliability. The insulating sheath 350 has a length of 0.375 inches extending from the second, up-hole end of the piston 300 in the down-hole direction. The insulating sheath includes a first cylindrical portion 360, a circumferential groove 390, a second cylindrical portion 370 and a third cylindrical portion 380. The first cylindrical portion 360 has a diameter of 0.373 inches and a length of 0.145 inches. The insulating sheath has a circumferential groove 390 to receive an O ring. The circumferential groove is 0.145 inches from the second, up-hole end of the piston and is 0.085 inches wide. The second cylindrical portion 370 extends from 0.230 inches from the second, up-hole end of the piston to 0.303 inches from the second end of the piston. The second cylindrical portion 370 of the insulating sheath has a diameter of 0.373 inches. The third cylindrical portion 380 extends from 0.303 inches from the second, up-hole end of the piston and has a length of 0.72 inches. The third cylindrical portion 380 has a diameter of 0.378 inches. Preferably, portion 380 has a dimensional tolerance of 0.0005 inches. In use, the piston is placed into the first portion 260 of the case having a diameter of 0.374 inches. The slight excess diameter of the third cylindrical portion 380 (0.004 inches greater than the diameter of the first portion 260 of the case) of the insulating sheath combined with the slightly (0.01 inch) smaller diameter of the first 360 and second 370 cylindrical portions, further combined with an O ring in circumferential groove 390 provides an appropriate fit between the two components. The slightly excess diameter of the third cylindrical portion 380 also reduces the incidence where, upon exposure to the pressure wave of a blast, the piston moves too far and makes an incorrect electrical connection, preventing the remainder of the string from working correctly. When assembled and before use, the non-insulated portion of shaft 310 protrudes from case 200 to facilitate electrical connection. When assembled and before use, the insulating sheath 350 is coplanar with the down-hole end 201 of case 200.

During assembly of the switch, a precise amount of lubricant is placed in the first portion of the case before the piston is inserted into the case to facilitate the correct movement of the piston upon exposure to a pressure wave. The preferred lubricant is Red "N" tacky #2. The amount of lubricant is preferably 0.0065 grams with a tolerance of 0.0005 grams. If too much lubricant is used, the piston will not be displaced by the blast a sufficient distance to make an electrical connection because the excess lubricant will prevent it. If too little lubricant is used, the piston will not be displaced by the blast a sufficient distance to make an electrical connection because excess friction will prevent it.

Figure 4:
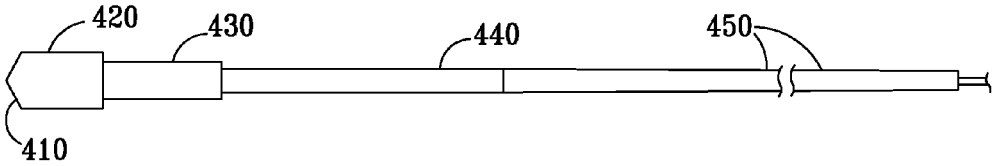

FIG. 4 shows features of dart 400. The switch includes a conductive rigid dart 400 having a length of approximately 2.625 inches having a first, down-hole end and a second, up-hole end. The first, down-hole end has a protruding surface 410 to facilitate interaction with the recessed portion 315 of the piston during movement in response to a pressure wave and also to facilitate electrical connection between the dart and piston. The protruding surface 410 may be conical, frustoconical, convex or other protruding surface. Typically protruding surface 410 and recessed portion 315 will have shapes selected to match but that is not required is reliable electrical connection is maintained during all phases of use. The dart is placed inside a spring. The spring preferably has a length of 0.655 inches, an outside diameter of 0.167 inches, and 8.5 coils over the length of the spring. The spring is preferably made of 0.018 inch music wire. The spring facilitates electrical connection with the piston and facilitates proper movement of the dart in response to a blast.

The dart contains four sections. The first conical portion 400 and second cylindrical portion 420 having a combined length of 0.725 inches and a diameter of 0.188 inches. A third cylindrical portion 430 has a length of 0.400 inches and a diameter of 0.125 inches and a fourth cylindrical portion having a length of 1.500 inches and a diameter that tapers from 0.080 inches to 0.063 inches. The overall length of the dart is 2.625 inches. The dart is preferably made of stress-proof steel. The dart is moved from a first position to a second position by the movement of the piston in response to the pressure wave. The spring rests on shelf 577 shown in FIG. 5A and holds the dart in the first position until moved to the second position by the piston. The dart 400 is placed inside insert 500 and extends beyond the up-hole end of the insert 500. The portion of the dart 400 inside the electrically conduction portion of the insert is insulated to maintain electrical isolation between the dart and the insert prior to a blast. Preferably the dart is insulated with a Teflon sleeve 450. The portion of the dart 400 extending beyond the insert 500 is electrically connected to a second through wire (not shown). Prior to a blast the through wire is electrically connected to the piston 300 on to the live charge which is down-hole. After a blast, the dart 400 and through wire are electrically connected to the insert 500 which is electrically connected to the next up-hole explosive charge.

Figure 5B:
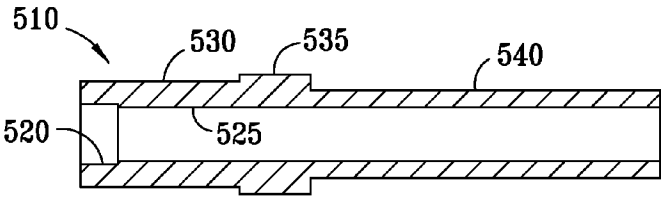
Figure 5A:
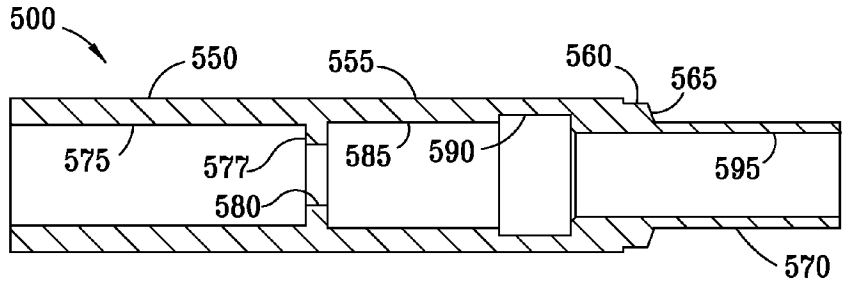
Figure 6:
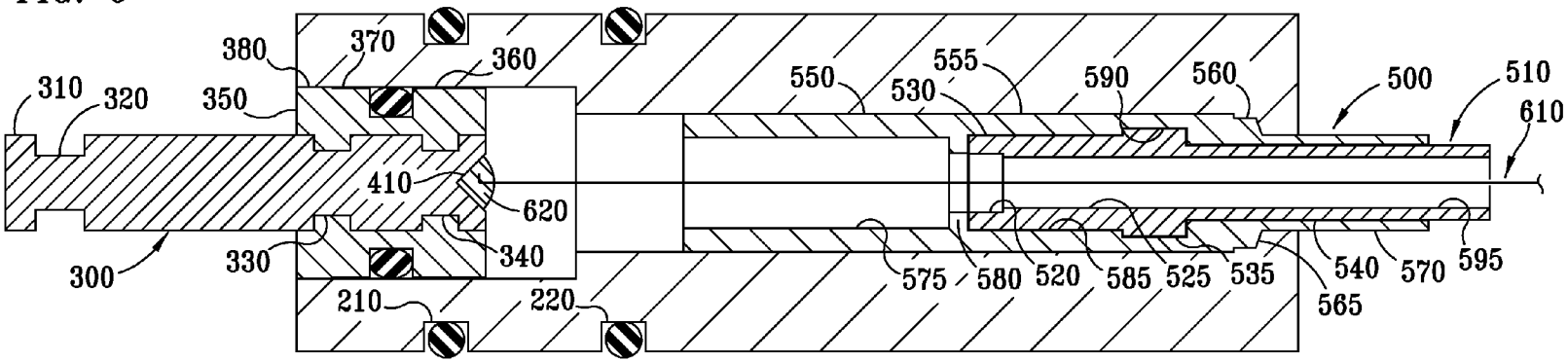

FIGS. 5A and 5B show details of insert 500. The insert 500 comprises an electrically conductive component 510 shown in FIG. 5B surrounded by an insulating sheath 550 shown in FIG. 5A. The electrically conductive component has a length of 1.106 inches and the insulating sheath has a length of 1.690 inches. When assembled, the insert has a first, down-hole end and a second, up-hole end. The first, down-hole end comprises the insulating sheath 550 having a uniform diameter of 0.320 inches and the conducting component 510 is placed into insulating sheath 550 is approximately 0.659 inches from the first, down-hole end of insulating sheath 550 before the electrically conductive component 510 begins. The insert 500 is designed to be inserted into the second section 270 of the case and extend beyond the up-hole end of the case. The slightly larger diameter of the insulating sheath 550 (0.008 inches) provides a tight fit between the case 200 and the insulating sheath 550 of the insert 500. The exterior diameter of the insulating sheath 550 may be between 0.001 and 0.01 inches larger than the interior diameter of the corresponding portion of the case. The electrically conductive component 510 has longitudinal internal passage having two sections 520, 525. The initial passage 520 extends from the first, down-hole end of the electrically conducting component for a length of 0.063 inches and has a diameter of 0.125 inches. The remainder of the internal passage 525 has a diameter of 0.113 inches and extends for the remaining length of the electrically conducting component 510 of the insert 500. The exterior of the electrically conducting component 510 has three sections 530, 535, 540. The first section 530 extends from the first end for a length of 0.326 inches and has a diameter of 0.220 inches. The second section 535 extends from 0.326 inches from the first end for a length of 0.150 inches and has a diameter of 0.250. The third section 540 extends the remainder of the length of the electrically conductive component and has a diameter of 0.175 inches.

The exterior of the insulating sheath shown in FIG. 5A has four sections 555, 560, 565, 570. The first section 555 extends from the first end for a length of 1.244 inches and has a uniform diameter of 0.320 inches. The second section 560 extends for the next 0.050 inches and has a diameter of 0.300 inches. The third section 565 extends for the next 0.015 inches and has a reducing diameter at an angle of 70 degrees. The final section 570 extends for the remaining length of the insulating sheath and has a diameter of 0.220 inches. The interior of the insulating sheath has five sections 575, 580, 585, 590, 595. The first section 575 extends from the first end for a length of approximately 0.600 inches. The first section 575 has an initial diameter of 0.210 inches and tapers to a final diameter of 0.200 inches. The second section 580 extends for the next approximately 0.060 inches and has a reduced diameter of 0.150 inches. The third section 585 extends for the next approximately 0.326 inches and has a diameter of 0.220 inches to match the dimension of the electrically conductive component. The fourth section 590 extends from 1.690 inches from the first end of the insert to 1.840 inches from the first end. The fourth section 590 has a diameter of 0.250 inches. The fifth section 595 of the insulating sheath extends the remaining length of approximately 0.545 additional inches and has a diameter of 0.220 inches.

The preferred embodiment described herein may be modified by one of ordinary skill and the description herein does not limit the scope of the invention.

I claim:

1. A fire pressure switch comprising:

a case having a first down-hole end and a second up-hole end and an axial passage therethrough the axial passage having at least two sections having different diameters;

an electrically conductive piston having a down-hole end and an up-hole end, the second end having a recessed portion;

a portion of the up-hole portion of the piston surrounded by an injection molded sheath;

the piston having one or more circumferential grooves which are filled with insulating material comprising portions of the sheath;

the sheath frictionally engaging a portion of the axial passage of the case;

a space between the up-hole end of the piston and the down-hole end of an insert;

a lubricant in the space comprising approximately 0.0065 ounces of lubricant;

a conductive rigid dart having a conical down-hole head and a tapered up-hole tail;

a portion of the tapered tail surrounded by a spring;

the spring maintaining the dart in electrical connection with the piston and permitting movement of the dart between a position which is electrically insulated from an insert and a position which is electrically connected to the insert;

the dart having an insulating sleeve surrounding a portion of the tail;

an insert having an electrically conductive inner portion and an electrically insulated sheath and having an axial passage having a diameter larger than the diameter of the dart;

the electrically insulating sheath having a uniform outer diameter which is larger than the interior diameter of a corresponding portion of the case by between 0.001 and 0.01 inches.

2. A fire pressure switch of claim 1, wherein the case is anodized and has an exterior color indicative of the type of diode connected to the switch.

3. A fire pressure switch of claim 1, which resists at least 18,000 pounds per square inch of pressure.

4. A fire pressure switch of claim 1, further comprising a wire electrically connected to the piston and a clear sleeve surrounding the piston, wire and electrical connection.

5. An electrical connector comprising:

a case having a first down-hole end and a second up-hole end and an axial passage therethrough;

an electrically conductive piston having a down-hole end and an up-hole end, the second end having a wire electrically connected to the up-hole end of the piston;

a portion of the up-hole portion of the piston surrounded by an injection molded sheath;

the piston having one or more grooves which are filled with insulating material comprising portions of the sheath;

the sheath frictionally engaging a portion of the axial passage of the case;

a space between the up-hole end of the piston and the down-hole end of an insert;

a lubricant in the space comprising approximately 0.0065 grams of lubricant.

* * * * *